US007125323B1

(12) United States Patent
Chuang

(10) Patent No.: US 7,125,323 B1
(45) Date of Patent: Oct. 24, 2006

(54) CLUTCH DEVICE FOR A ROLLERS' SWINGING MECHANISM OF A BELT SANDER

(76) Inventor: Bor Yann Chuang, No. 87, Yong fong N. Rd., Taiping City, Taichung County 411 (TW)

( * ) Notice: Subject to any disclaimer, the term of this patent is extended or adjusted under 35 U.S.C. 154(b) by 0 days.

(21) Appl. No.: 11/211,523

(22) Filed: Aug. 26, 2005

(51) Int. Cl.
*B24B 7/06* (2006.01)

(52) U.S. Cl. ..... 451/130; 451/65; 451/150

(58) Field of Classification Search ..... 451/130, 451/65, 150, 157, 184, 300, 304
See application file for complete search history.

(56) References Cited

U.S. PATENT DOCUMENTS 335,117 A * 2/1886 Elmer et al. ..... 451/131
446,196 A * 2/1891 Wiederer ..... 451/157
1,936,991 A * 11/1933 Pinkney ..... 451/65
2,858,701 A * 11/1958 Willcox ..... 74/22 R
3,032,931 A * 5/1962 Eversole ..... 451/121
5,531,636 A * 7/1996 Bissen ..... 451/130

* cited by examiner

*Primary Examiner*—Robert A. Rose
(74) *Attorney, Agent, or Firm*—Troxell Law Office, PLLC

(57) ABSTRACT

A clutch device for a rollers' swinging mechanism of a belt sander, which includes a roller set, a swinging gear set, is composed of a control bar, a linking member and a clutch member. The roller set is driven by the swinging gear set to carry out an axial movement. The control bar is set with an eccentric wheel at its lower side, and the eccentric wheel is connected with the linking member, which is pivotally connected with the clutch member at its other end. When the eccentric wheel is driven to turn around, the linking member moves successively the clutch member to work for controlling the swinging gear set to provide two operating models optional for the belt sander.

5 Claims, 5 Drawing Sheets

CLUTCH DEVICE FOR A ROLLERS' SWINGING MECHANISM OF A BELT SANDER

BACKGROUND OF THE INVENTION

1. Field of the Invention

This invention relates to a belt sander, particularly one that has a clutch device for controlling a swinging gear set to provide two operating models optional.

2. Description of the Prior Art

Common conventional belt sander is always composed of a roller set and a motor set. The roller set and the motor set are mounted with and rotated by a belt. The roller set is wrapped up with a sanding cloth for sanding and can only rotated, resulting in a low precision only for rough grinding. For upgrading grinding precision, a known improved swinging belt sander includes a roller set, a swinging gear set and a motor set, having its difference from the conventional ones in that the swinging gear set rotated by the motor set reciprocates axially, revving up the precision sanding. Though the precision is really improved, but it takes relatively much time for operation without option for a refined sanding or rough one, causing a higher cost and a lower efficiency.

SUMMARY OF THE INVENTION

The prime object of this invention is to offer a clutch device for a rollers' swinging mechanism of a belt sander.

The main characteristics of the invention a clutch device for a belt sander including a roller set, a swinging gear set, and a motor set. A belt mounted on the roller set and the motor set is able to force the roller set to rotate when the motor is started. The swinging gear set rotated by another belt mounted on the motor can carry out an eccentric rotation itself, enabling a pulling claw fixed with it to swing eccentrically, then enabling the roller set to move and reciprocate axially. The clutch device is composed of a control bar, a linking member and a clutch member. The control bar is fixed with an eccentric wheel at its end, and the eccentric wheel has an eccentric shaft at its lower surface for sliding into a groove of the linking member. The linking member is cut with a shaft hole at its bending corner to be fixed at a preset position, having a pivot at its other end, and the pivot has a sliding projection to slide into the clutching member. As the control bar is turned around, the eccentric wheel on it is to rotate the linking member, enabling the pivot to move and control the clutch member to get separated or jointed by the sliding projection. Such a separation or jointing provides more operating options and can shorten operating time to save cost.

BRIEF DESCRIPTION OF DRAWINGS

This invention is better understood by referring to the accompanying drawings, wherein.

DETAILED DESCRIPTION OF THE PREFERRED EMBODIMENT

Figure 1:
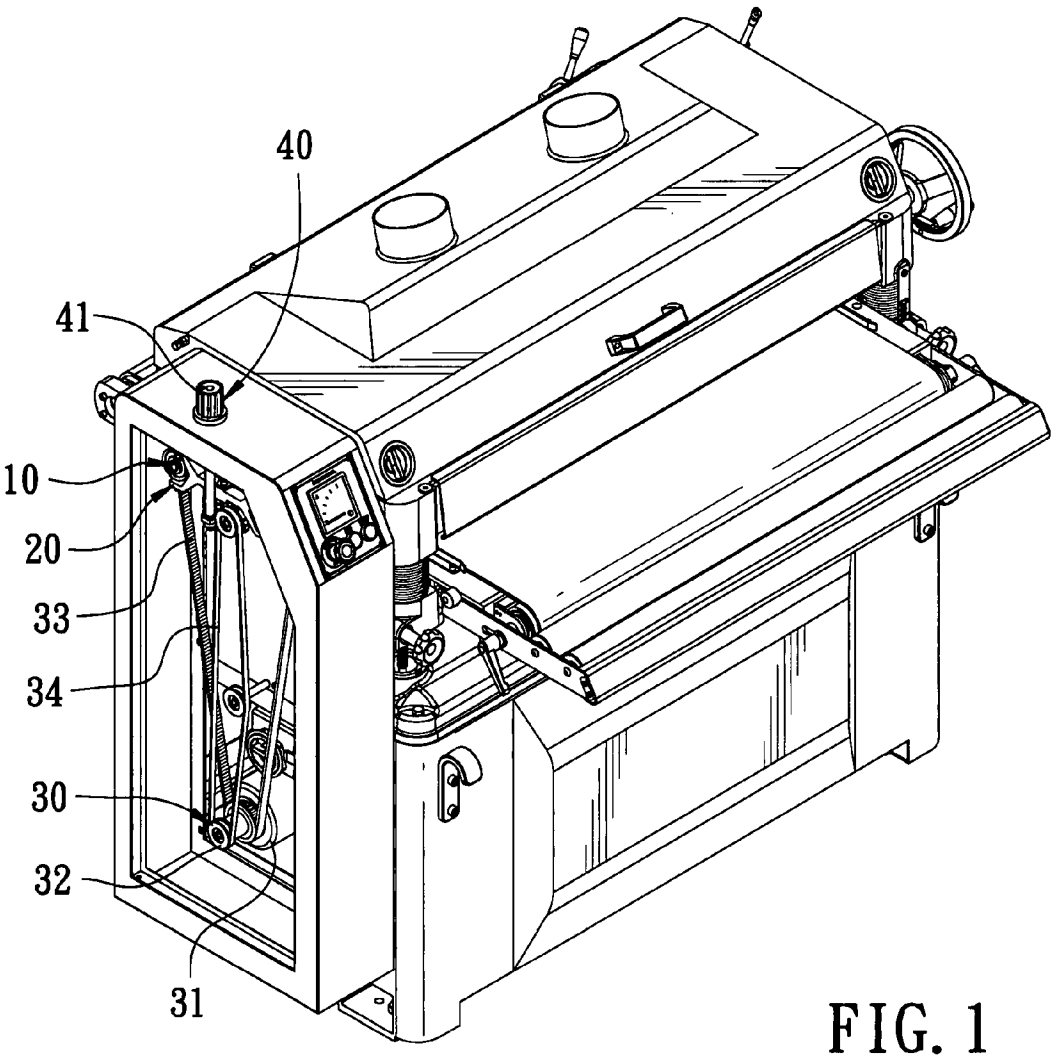
FIG. 1 is a perspective view of a belt sander in the present invention.
Figure 2:
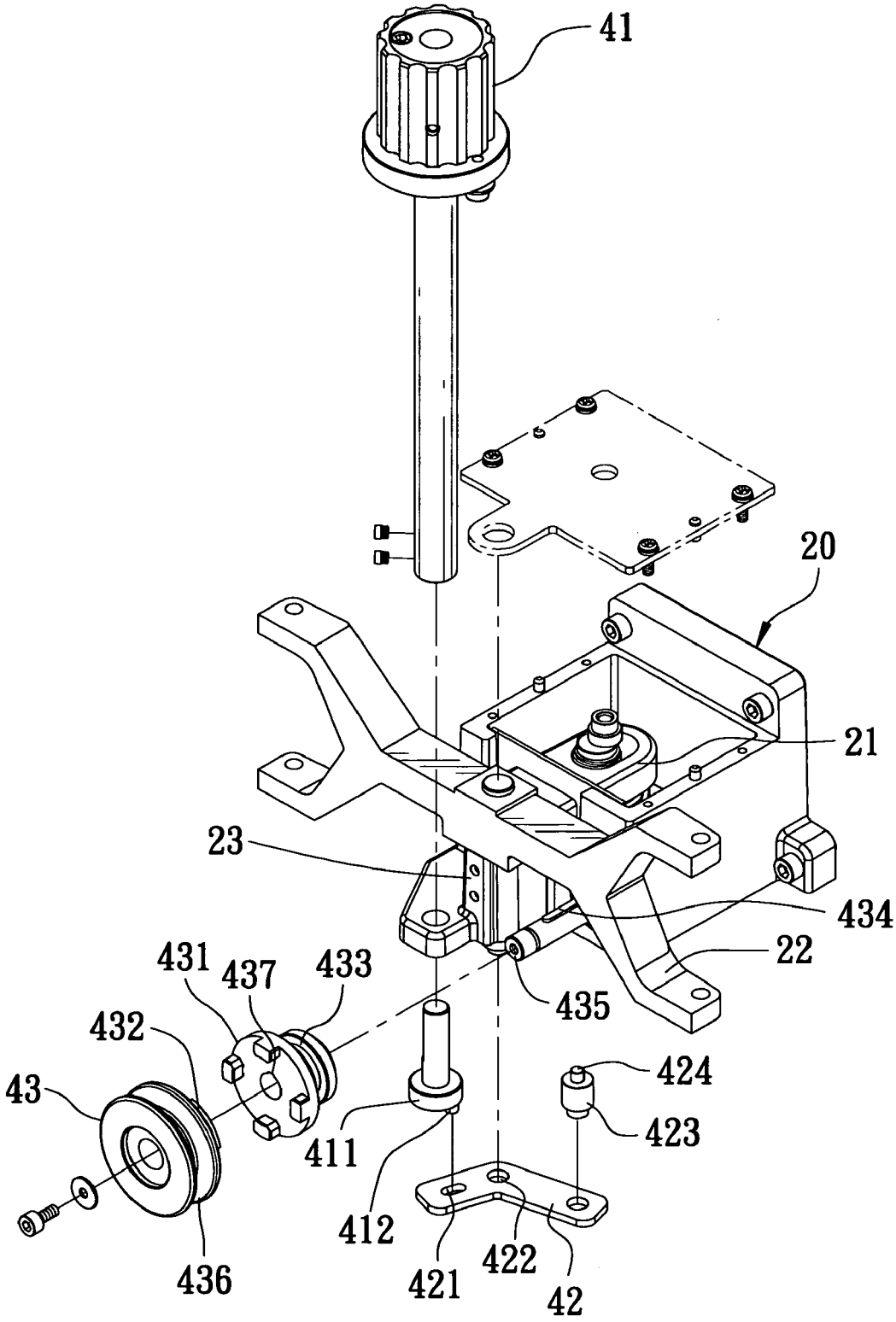
FIG. 2 is a partial exploded perspective view of the belt sander in the present invention.
Figure 5:
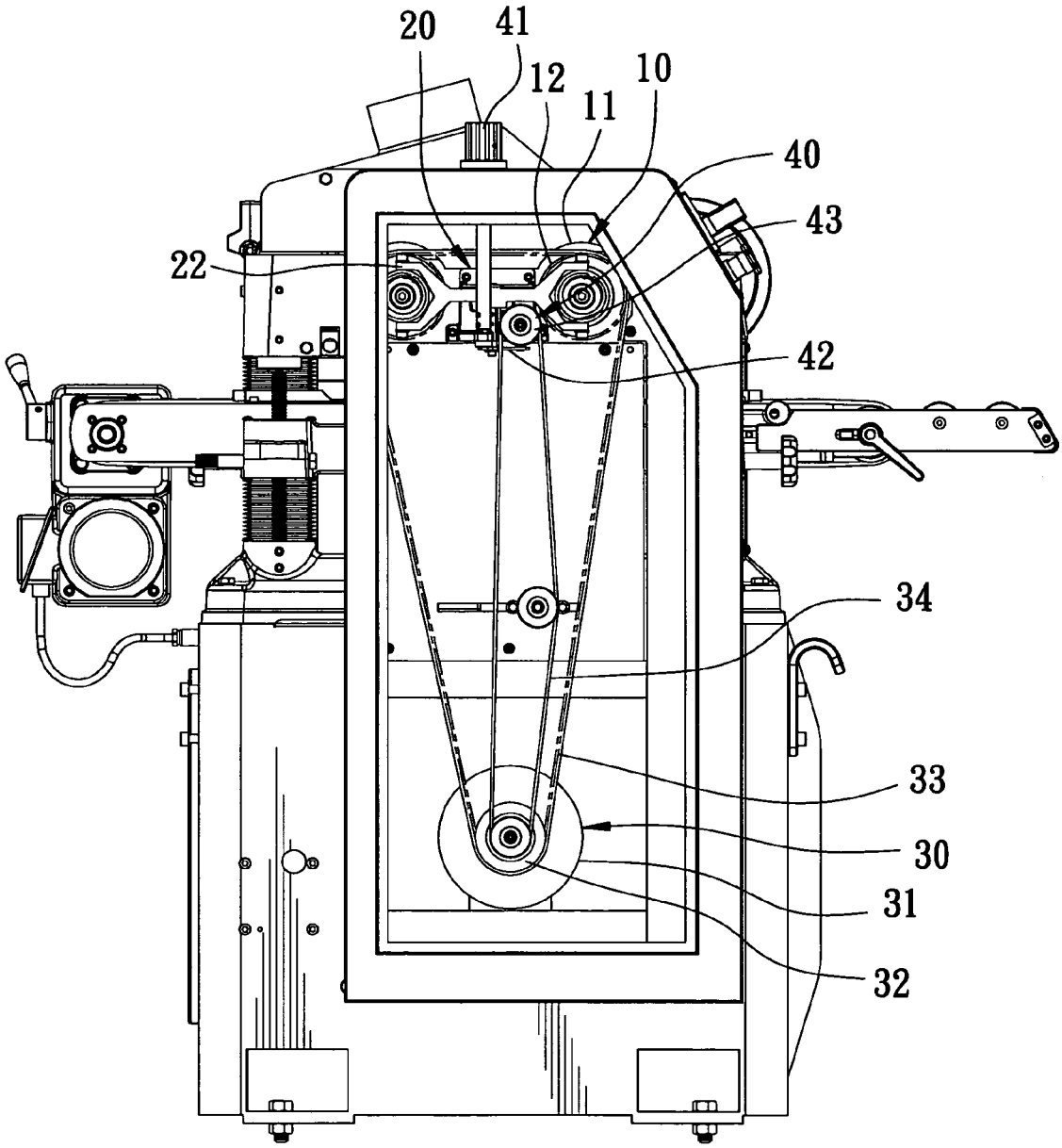
FIG. 5 is a side view of the belt sander in the present invention.

FIGS. 1, 2 and 5 show a preferred embodiment of a clutching device for a rollers' swinging mechanism of a belt sander in the present invention, and the belt sander includes a roller set 10, a swinging gear set 20, a motor set 30 and the clutching device 40.

The roller set 10 is wrapped up with a sanding cloth 11 for each roller, located at a preset position and connected with a belt wheel 12 respectively at each roller's end.

The swinging gear set 20 is mainly composed of an eccentric gear set 21 and a pulling claw 22 with a T-shaped cross section located at its outside. The pulling claw 22 is pivotally connected with a fixing base 23 at its center.

The motor set 30 consists of a motor 31 fixed with two belt wheels 32 mounted around with a first belt 33 and a secondary belt 34 respectively. The first belt 33 is mounted around the belt wheel 12 of the roller set 10 and the secondary belt 34 is mounted around the clutch device 40.

The clutch device 40 is composed of a control bar 41, a linking member 42 and a clutch member 43. The control bar 41, is able to be rotated only in a certain definite angle, is pivotally fixed at a preset position, having an eccentric wheel 411 fixed at its end and an eccentric axis 412 at its bottom of the eccentric wheel 411, so that the eccentric shaft 412 may slide into a sliding groove 421 of the linking member 42. The sliding groove 421 is shaped rectangular, enabling the eccentric shaft 412 to move along in it in a line. The linking member 42 is made of a L-shaped steel plate, which is cut with a shaft hole 422 at its bending corner and screwed together with the fixing base 23 at its bottom, and a pivot 423 riveted at its other end and having a sliding projection 424 on top that is able to slide and fit in the clutch member 43. The clutching member 43 is composed of a male clutch 431, a female clutch 432 and a worm 435. The male clutch 431 has an annular restrictive groove 433 in its rear portion for the sliding projection 424 of the pivot 423 to slide into and fitted restrictedly within it. The male clutch 431 is provided with a recess 437 formed in the surface of a center hole, and the worm 435 is provided with a double-head projection 434 on its outer connected so that the male clutch 431 may shift on the worm 435 back and forth by means of the recess 437 fitting with the double-head projection 434, in addition to rotating with the worm 435. The worm 435 is engaged with the swinging gear set 20 to rotate together. The female clutch 432 has an annular groove 436 at its outside to be mounted by the secondary belt 34.

Figure 3:
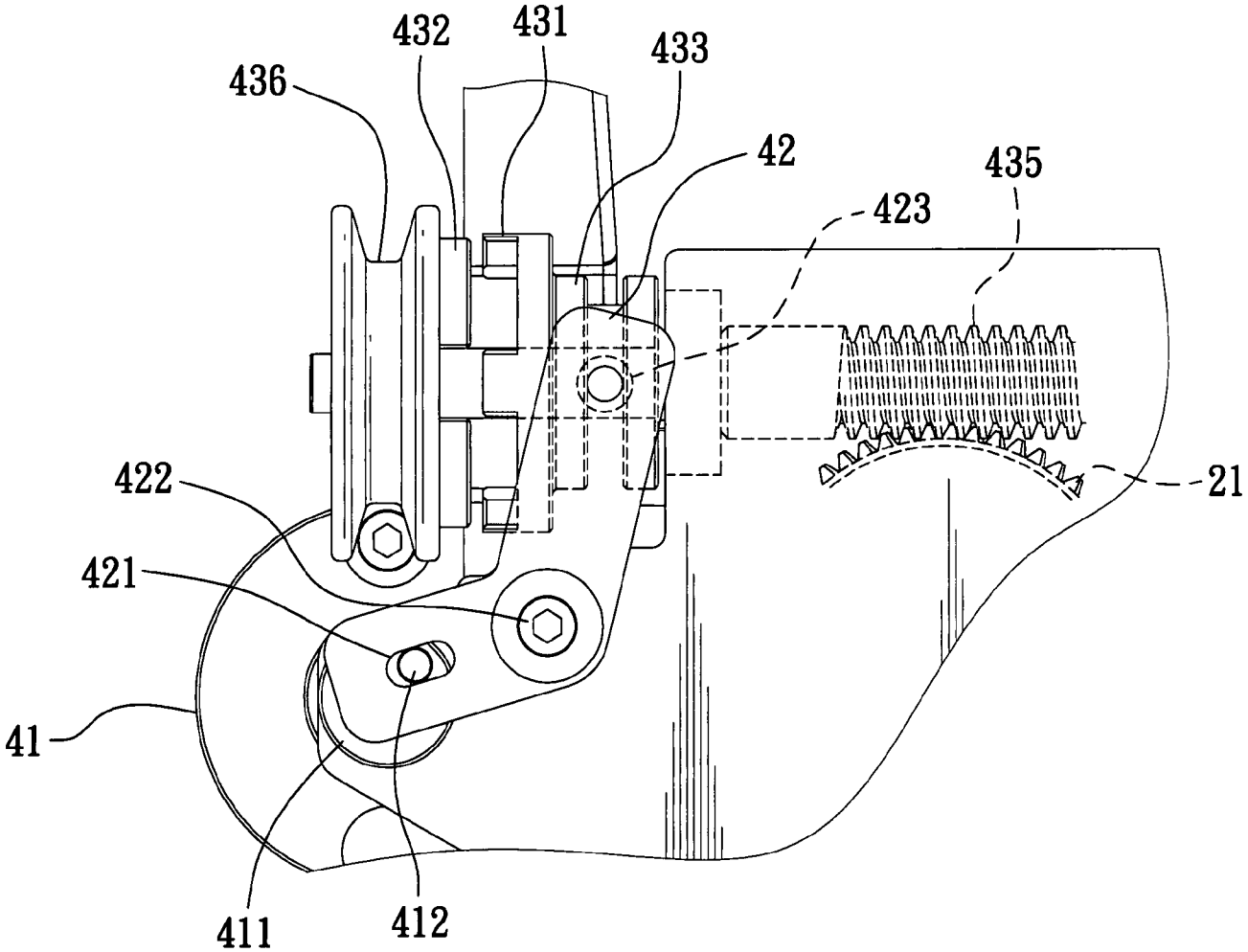
FIG. 3 is a perspective view of a clutching device in the present invention, showing it being in a disconnected state.
Figure 4:
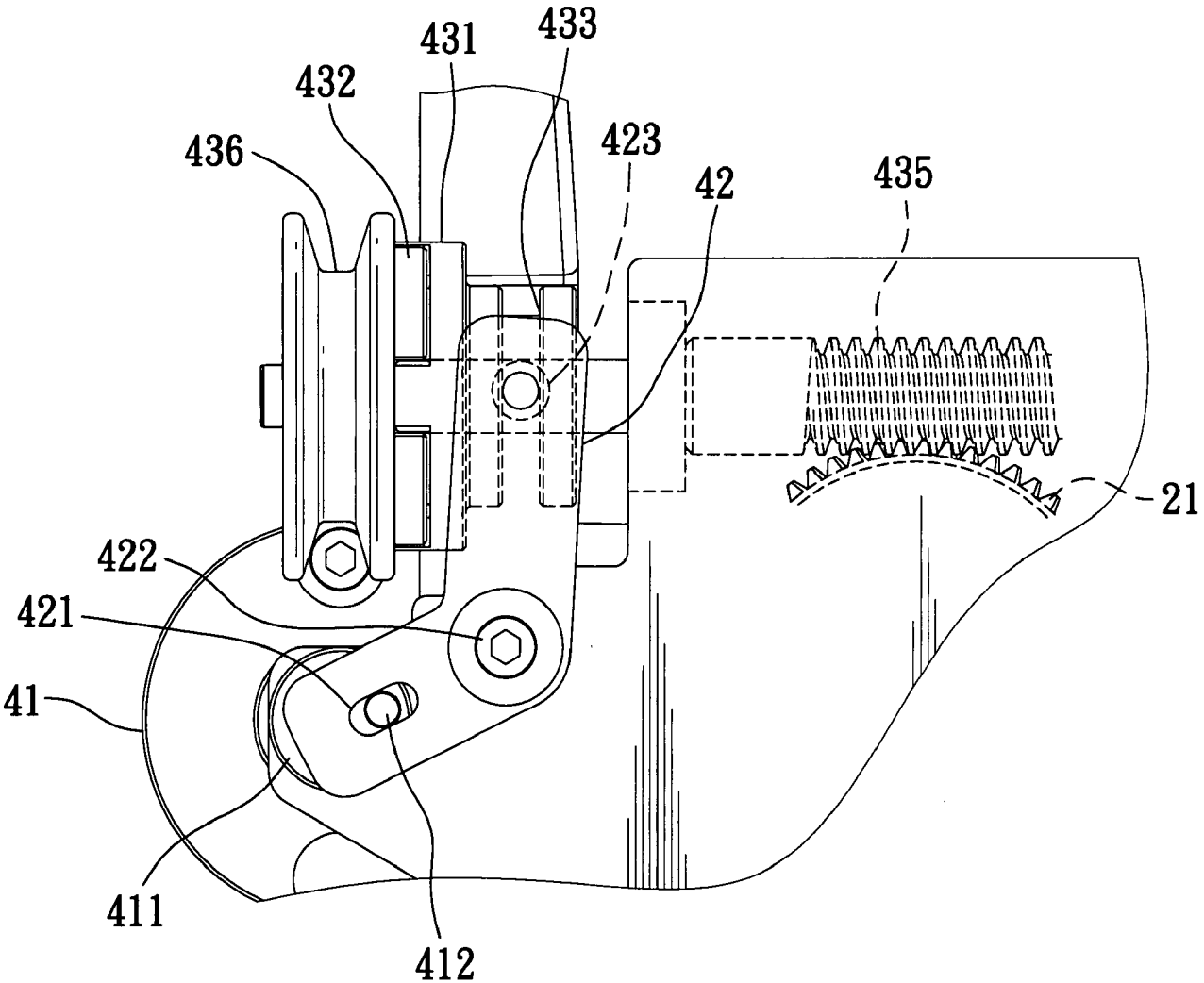
FIG. 4 is a perspective view of the clutch device in the present invention, showing it in a connected state.

In using, as shown in FIGS. 2, 3 and 4, when the motor 31 is started, it rotates the belt wheel 32, which moves synchronously the first belt 33 and the secondary belt 34. The first belt 33 will then rotate the belt wheel 12, enabling the roller set 10 to rotate and carry out sanding. At the same time, the secondary belt 34 will rotate the female clutch 432. As the secondary belt 34 and the first belt 33 are normally kept apart, the female clutch 432 is merely rotating idly. In order to connect the male clutch 431 with the female clutch 432 to rotate the male clutch 431, the control bar 41 has to be turned around in a certain angle so that the eccentric wheel 411 at the bottom is made to rotate with the same angle, enabling the eccentric shaft 412 of the eccentric wheel 411 to shift the linking member 42. If the linking member 42 is shifted, two ends of the linking member 42 will then swing with the shaft hole 422 as a pivot, making the pivot 423 move forwards to enable the sliding projection 424 on it to push the restrictive groove 433 forwards so as to force the male clutch 431 be connected with the female clutch 432 for moving together. Then, the worm 435 is rotated and subsequently rotating the eccentric gear set 21, which then moves accordingly the pulling claw 22 to rotate eccentrically, enabling the roller set 10 to rotate and also reciprocate axially. On the contrary, if the roller set 10 is wanted to be stopped its reciprocating movement, just turn around the control bar 41 reversely to make the pivot 423 move backwards so that the sliding projection 424 on it moves backwards as well, keeping the male clutch 431 disconnected from the female clutch 432 with the eccentric gear set 21 disabled. Then, the female clutch 432 mounted by the first belt 34 keeps rotating idly.

Controlled additionally by the clutching device 40, the belt sander in the present invention can be adjusted in accordance with a variety of needed sanding precision to gain an optimum grinding work, resulting in a reduced operating time, less consumption of sanding cloth and more varied operation.

While the preferred embodiment of the invention has been described above, it will be recognized and understood that various modifications may be made therein and the appended claims are intended to cover all such modifications that may fall within the spirit and scope of the invention.

What is claimed is:

1. A belt sander comprising:

a roller set located at a preset position and wrapped up with a sanding cloth and connected with a belt wheel for each roller;

a swinging gear set having an eccentric gear set and a pulling claw fixed at an outside and pivotally connected with a fixing base at a center thereof;

a motor set having a motor fixed with two belt wheels mounted around by a first belt and a secondary belt respectively, said first belt also mounting around said belt wheel of said roller set; and, said clutch device composed of a control bar, a linking member and a clutch member, said control bar pivotally connected at a preset position and able to turn around in a certain definite angle, an eccentric wheel fixed at a lower end of said control bar for sliding into a sliding groove of said linking member, said linking member having a bending corner fixed with a lower side of said fixing base and having a pivot riveted at an end for sliding into said clutch member, said clutch member consisting of a male clutch, a female clutch and a worm, said male clutch fitting with said pivot and having a rear side connected with said worm, said worm engaging with said swinging gear set, said female clutch having an annular groove formed in an outer portion to be mounted around by said secondary belt.

2. The belt sander as claimed in claim 1, wherein said linking member is an L-shaped steel plate.

3. The belt sander as claimed in claim 1, wherein said linking member is cut with a shaft hole at the bending corner for pivotally connecting with the lower side of said fixing base.

4. The belt sander as claimed in claim 1, wherein said eccentric wheel has an eccentric shaft at an eccentric position of a lower surface, said eccentric shaft sliding in said sliding groove of said linking member and moving restrictedly therein.

5. The belt sander as claimed in claim 1, wherein said male clutch has an annular restrictive groove in the rear side for a sliding projection on said pivot to slide into and fit restrictedly therein.

* * * * *